United States Patent [19]

Reed

[11] Patent Number: 4,581,913

[45] Date of Patent: Apr. 15, 1986

[54] METHOD FOR IMPROVING THE RELEASE AND FINISH CHARACTERISTICS OF METAL STAMPING DIES

[75] Inventor: James L. Reed, Grand Rapids, Mich.

[73] Assignee: Luster Finish, Inc., Grand Rapids, Mich.

[21] Appl. No.: 517,836

[22] Filed: Jul. 27, 1983

[51] Int. Cl.[4] ..... C21D 7/06

[52] U.S. Cl. ..... 72/53; 29/90 A; 51/320

[58] Field of Search ..... 72/53, 42; 51/320; 29/90 A

[56] References Cited

U.S. PATENT DOCUMENTS

| | | | |
|---|---|---|---|
| 602,416 | 4/1898 | McCool . | |
| 1,833,025 | 7/1929 | Langenberg . | |
| 2,248,530 | 7/1941 | Granger et al. | 72/53 |
| 3,073,022 | 1/1963 | Bush et al. | 29/553 |
| 3,410,124 | 11/1968 | Suwa | 72/53 |
| 3,485,073 | 12/1969 | Burney | 72/53 |
| 3,574,658 | 12/1967 | Fulk et al. | 72/53 |
| 3,754,976 | 8/1973 | Babecki et al. | 72/53 |
| 4,034,585 | 7/1977 | Straub | 72/53 |
| 4,085,792 | 4/1978 | Eberle | 164/72 |
| 4,228,670 | 10/1980 | Corti et al. | 72/53 |
| 4,258,084 | 3/1981 | Hayden | 72/53 |

FOREIGN PATENT DOCUMENTS

| | | | |
|---|---|---|---|
| 1533480 | 6/1968 | France . | |
| 303487 | 5/1928 | United Kingdom . | |
| 1145147 | 3/1969 | United Kingdom . | |
| 5611 | 11/1979 | United Kingdom . | |
| 165183 | 9/1964 | U.S.S.R. | 72/53 |

OTHER PUBLICATIONS

Woelfel and Mulhal, "Glass Bead Impact Blasting", Sep. 1982, vol. 122, No. 4, pp. 57–59.

"Automatic Shot-Blasting of Hot Ingot Moulds", *Process Control and Automation,* vol. 10, Dec., 1963.

*Primary Examiner*—Daniel C. Crane

*Assistant Examiner*—David B. Jones

*Attorney, Agent, or Firm*—John A. Waters

[57] ABSTRACT

A method for improving the release and finish characteristics of metal stamping dies includes shot peening the interior die cavity walls with substantially spherical shot having a hardness value at least equal to the hardness value of the die cavity walls. Optimizing the parameters of the peening process, such as the Almen intensity and the shot type, size, hardness and uniformity, maximizes the improvement to the release and finish characteristics of the die. Optionally, the initial shot peening is followed by a second shot peening with substantially spherical glass beads. Metal stamping dies shot peened in accordance with the present method exhibit substantial improvement in their release and finish characteristics over unpeened dies.

10 Claims, No Drawings

METHOD FOR IMPROVING THE RELEASE AND FINISH CHARACTERISTICS OF METAL STAMPING DIES

BACKGROUND OF THE INVENTION

1. Field of the Invention

The present invention relates to metal stamping dies, and, more particularly, to a method for improving the release and finish characteristics of metal stamping dies through shot peening.

2. Description of the Prior Art

The use of metal stamping to produce a wide variety of metal parts is widespread. While there are variations of the metal stamping process, such as forming, piercing, deep drawing and the like and combinations thereof, and different types of dies, such as single and multiple cavity dies and progressive dies, most of the principles and techniques are the same. The problems are also often the same. One of the major problems which is common to virtually all metal stamping operations involving drawing or deformation of the workpiece,whereby the workpiece contacts the interior die cavity walls during the stamping operation, is a poor release characteristic between the workpiece and the die cavity walls. Poor release characteristics, which causes problems both during the stamping downstroke and the upstroke and workpiece removal stage, invariably leads to problems such as machine jams or smashups, misformed and non-uniform parts and poor finish characteristics on the workpiece surface proximal to the die cavity walls, such as scratches, galling, scoring, random shiny spots and the like. Although a poor release characteristic is most often the cause of a poor finish, poor finish can also be caused by other factors, such as heat buildup, improper lubrication, surface flaws and the like.

Because of the high cost of rejected parts and the down time due to die maintenance and reconditioning, as well as the potential very high cost occasioned by a machine or die jam or smashup, constant efforts are being made to improve the release and finish characteristics of metal stamping dies. These efforts range from varying the composition of the die material to coating the interior die cavity walls with release agents, plating and the like. Even the die designer continually attempt to improve the release and finish characteristics of dies by experimenting with variations of draft angles and the like.

While there has been steady improvement over the years, there is a continuing need for further improvements, especially improvements that are economical, reliable and durable.

SUMMARY OF THE INVENTION

According to the present invention, there is provided a method for improving the release and finish characteristics of metal stamping dies which is simple and effective, as well as reliable and economical. In addition, dies treated in accordance with the method exhibit a consistently longer life, both between required periodic maintenance and reconditioning and to the time where die replacement is required.

The method includes shot peening the interior die cavity walls with substantially spherical shot having a hardness value at least equal to the hardness value of the die cavity walls. Preferably, the peening is conducted at an Almen intensity sufficient to achieve complete coverage and saturation and to produce a compressive stress layer depth of at least about 0.02 inch.

The preferred shot is steel shot having a Mil Spec size of from about SAE 70 to about SAE 230, with cast steel shot certified to Mil Spec 13165 being especially preferred.

Optionally, the initial shot peening is followed by a second shot peening with substantially spherical glass beads.

DESCRIPTION OF THE PREFERRED EMBODIMENT

The present invention was the result of the surprising discovery that shot peening metal stamping dies with generally spherical shot dramatically improves the release and finish characteristics of such dies, as well as substantially increasing die life. Heretofore, the accepted rule in die construction and maintenance and reconditioning, with respect to achieving satisfactory release and finish characteristics, was to provide the interior die cavity walls with as smooth and uniform a surface as possible. Although shot peening has been in widespread use for years to increase the fatigue life and prevent stress corrosion cracking of metal parts, an irregular peened surface on the interior die cavity walls would predictably adversely affect the release and finish characteristics of the die. Since any improvement in fatigue life or the prevention of stress corrosion cracking through shot peening would not be worth the sacrifice of having to accept poor release and finish characteristics of the die, shot peening has never been seriously considered for treatment of the interior die cavity walls of metal stamping dies.

In the broader aspects of the present invention, conventional shot peening techniques and equipment are utilized, i.e., the surface of the part is bombarded with shot by a peening apparatus under controlled conditions. However, in the preferred embodiment, optimum results are achieved by utilizing specific combinations of parameters with respect to shot type, size, hardness and Almen peening intensity. Examples of suitable conventional peening apparatus include air blasting equipment which propel the shot media at the part under air pressure, utilizing either suction, direct pressure or gravity feed, and airless or centrifugal wheel equipment which propels the shot media at the part by a rotating wheel. There are also freefall peening machines, where the shot media is dropped upon the part from various selected heights.

With respect to the shot peening media, the media must be substantially spherical. Irregular, angular or abrasive media, such as employed in grit blasting and sand blasting, are unacceptable in the method of the present invention. While a variety of generally spherical peening media may be utilized, such as steel shot, ceramic media and conditioned cut steel wire shot, steel shot is preferred. In the case of cut steel wire shot, it must be conditioned prior to use, such as by blasting it against a steel plate until the particles are rounded. Whichever peening media is selected, it must have a hardness value at least equal to the hardness value of the die cavity walls to achieve the improvements of the method of the present invention.

The peening process should be conducted under conditions that will yield substantially 100% coverage and saturation of the interior die cavity walls. In addition, it has been found that increasing the depth of the compressive stress layer provides additional improvement. A substantial improvement, especially in die life, is achieved when the compressive stress layer is about 0.02 inch or greater. This increase in die life is partly due to the fact that some surface metal is removed during each periodic maintenance or reconditioning operation. Accordingly, the greater the depth of the compressive stress layer, the more the amount of metal that can be removed during maintenance and reconditioning operations before the benefits of the shot peening are negated.

The optimum shot peening intensity will vary depending upon the hardness of the dies and the type of die metal. Under the generally accepted Almen shot peening intensity standard, which was developed by the General Motors Research Laboratories Division of General Motors Corporation, the various variables of shot peening are integrated into a single scale for measuring, specifying and duplicating shot peening intensities and results. All measurements are made on the standard Almen No. 2 gage, as shown in the SAE Manual on Shot Peening, AMS 2430 and MIL S-13165. Even though the exact optimum Almen intensity will vary as the die material and shot parameters vary, it has been found that when regular hardness steel shot, with a Rockwell hardness of from about C45 to about C55, is utilized, the desired compressive stress layer of at least about 0.02 inch will be achieved with Almen intensities of from about 0.004 to about 0.014 $C^2$.

Also, while the optimum size of the shot peening media will vary, steel shot with a Mil Spec size of from about SAE 70 to about SAE 230 is preferred for most applications. For optimum reliability and uniformity of the peening media, cast steel shot certified to Mil Spec 13165 is especially preferred.

Finally, it has been found that yet further improvement is achieved by following the initial shot peening with a second shot peening utilizing substantially spherical glass beads. The optional second peening procedure provides primarily a cleaning function and enhances the uniformity of the peened die surface.

The improvement achieved in the die release and finish characteristics by the present method is consistent and dramatic over a wide range of varying die constructions. One of the clearest gages of improvement is to monitor the frequency of die cleaning and reconditioning that is required. Comparison testing between untreated dies and dies shot peened in accordance with the present invention at various stamping work stations at a major automotive assembly plant revealed consistent improvement with the shot peened dies. From large steel quarter panel dies to smaller front fender steel insert dies, the results are the same. The shot peened dies experienced far less down time and required far fewer periodic maintenance and reconditioning operations. The improvement as a function of reduced down time and periodic maintenance and reconditioning ranges from a factor of several fold to a factor of over 30. In addition, the surface finish of the stamped parts is consistently uniform and free from flaws.

In addition to the improvements that the present method provides with respect to release and finish characteristics and the reduction of down time and the need for periodic maintenance and reconditioning, additional advantages are achieved. Cost wise, the present method is less costly than most other surface treatments and coatings which are applied to the interior die cavity walls. Moreover, additional cost savings are realized during die reconditioning or modification. Coatings, such as plating, tend to chip and flake and eventually must be replaced at high cost. In the event that the die needs modification due to an engineering change or the like or requires a repair operation such as welding, only the immediate area that is altered or repaired may require repeening. In sharp contrast, such an isolated modification or repair in a plated die most often requires the entire die surface to be replated.

Thus, the surprising discovery that shot peening metal stamping dies in accordance with the present method dramatically improves release and finish characteristics, instead of adversely affecting them as would be predicted, has resulted in a simple, reliable and economical method which can benefit the entire metal stamping industry.

While the preferred embodiments of the present invention have been described and set forth, it will be obvious to those skilled in the art that various changes and modifications can be made without departing from the spirit of the present invention. Accordingly, the scope of the present invention is deemed to be limited only by the following appended claims.

The embodiments of the invention in which an exclusive property or privilege is claimed are defined as follows:

1. A method for improving the release and finish characteristics of a metal stamping die formed of steel comprising shot peening the interior die cavity walls with substantially spherical shot having a hardness value at least equal to the hardness value of said die cavity walls, the peened die cavity walls being employed to directly contact metal work-pieces inserted in the die, without the die cavity walls being plated prior or subsequent to peening.

2. The method according to claim 1 wherein said shot comprises steel shot.

3. The method according to claim 2 wherein said steel shot has a Mil Spec size of from about SAE 70 to about SAE 230.

4. The method according to claim 3 wherein said cavity walls are peened at an Almen intensity sufficient to produce a compressive stress layer depth of at least about 0.02 inch.

5. The method according to claim 4 wherein said steel shot comprises cast steel shot certified to Mil Spec 13165.

6. The method according to claim 4 wherein said shot peening is followed by a second shot peening with substantially spherical glass beads.

7. The method according to claim 1 wherein said shot peening is followed by a second shot peening with substantially spherical glass beads.

8. A method for improving the release and finish characteristics of a metal stamping die formed of unplated steel comprising shot peening the workpiece contacting interior die cavity walls with a shot peening media comprising substantially spherical steel shot having a hardness value at least equal to the hardness value of said die cavity walls, the media excluding any significant quantities of irregular, angular, or abrasive media.

9. A steel stamping die having improved release and finish characteristics comprising spherical shot peened, unplated, workpiece contacting interior die cavity walls that have been shot peened with substantially spherical shot having a hardness value at least equal to the hardness value of said die cavity walls such that said die cavity walls have a surface that is characteristic of a surface shot peened with substantially exclusively spherical shot, with the surface being substantially free of surface characteristics of the type produced by irregular or grit blasting media.

10. A steel stamping die having improved release and finish characteristics comprising spherical shot peened, unplated, workpiece contacting interior die cavity walls, with the walls having a peened surface to the extent of complete coverage and saturation and having a compressive stress layer of about 0.02 inches or greater.

* * * * *